US009236671B2

(12) United States Patent
Chen et al.

(10) Patent No.: US 9,236,671 B2
(45) Date of Patent: Jan. 12, 2016

(54) ELECTRICAL CONNECTOR HAVING A HOUSING WITH A HOLE WITH A PROTRUSION ENGAGING AN ENLARGED END ON A HOUSING OF A CORRESPONDING CONNECTOR

(71) Applicant: ADVANCED-CONNECTEK INC., New Taipei (TW)

(72) Inventors: Ching-Tien Chen, New Taipei (TW); Shu-Lin Duan, New Taipei (TW); Wei Wan, New Taipei (TW); Ping-Chuan Chu, New Taipei (TW); Xiao-Juan Qi, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/538,790

(22) Filed: Nov. 11, 2014

(65) Prior Publication Data

US 2015/0229051 A1 Aug. 13, 2015

(30) Foreign Application Priority Data

Feb. 7, 2014 (CN) ..... 2014 1 0044669

(51) Int. Cl.
*H01R 13/627* (2006.01)
*H01R 12/71* (2011.01)

(52) U.S. Cl.
CPC ..... *H01R 12/71* (2013.01); *H01R 13/6276* (2013.01)

(58) Field of Classification Search
CPC .. H01R 13/62; H01R 13/627; H01R 13/6271; H01R 13/6273; H01R 13/6276
USPC ..... 439/345–358
See application file for complete search history.

(56) References Cited

U.S. PATENT DOCUMENTS

| | | | | |
|---|---|---|---|---|
| 5,044,982 | A * | 9/1991 | Bertini | H01R 13/74 439/352 |
| 8,968,005 | B2 * | 3/2015 | Hirakawa | H01R 12/73 439/65 |
| 2002/0173197 | A1 * | 11/2002 | Endo | H01R 13/641 439/489 |
| 2015/0200492 | A1 * | 7/2015 | Endo | H01R 13/369 439/345 |

* cited by examiner

*Primary Examiner* — Chandrika Prasad

(57) ABSTRACT

A wire-to-board connector for connecting with a board-to-wire connector that includes a plastic body having a raised portion and two coupling portions, wherein the raised portion defines multiple through holes, each coupling portion is formed with an upright support having an enlarged top end, and multiple conductive terminals are fitted through the multiple through holes, wherein each conductive terminal has a fixed section, a solder section, and a connecting section. The wire-to-board connector comprises a dielectric housing and multiple conductive terminals. The dielectric housing defines two engaging holes and multiple positioning recesses. The conductive terminals of the wire-to-board connector are disposed in the positioning recesses for electrical connection to the connecting sections, wherein a protrusion is formed on an inner surface of each engaging hole, corresponding to the enlarged top end.

3 Claims, 5 Drawing Sheets

ELECTRICAL CONNECTOR HAVING A HOUSING WITH A HOLE WITH A PROTRUSION ENGAGING AN ENLARGED END ON A HOUSING OF A CORRESPONDING CONNECTOR

FIELD OF THE INVENTION

The present invention relates to an electrical connector to be installed at a cable for connection to a board-to-wire connector installed at a circuit board.

BACKGROUND OF THE INVENTION

Connectors are a circuit component that provides electrical connection between different electronic devices, so that electrical current or signal can be transmitted between the devices and thus enables the devices to communicate with each other. Since electronic devices are usually separated at a certain distance, cables are required for communication therebetween. To facilitate a connection, each cable and its associated circuit board need to be installed with a connector. Generally, the connector installed at a cable is called a wire-to-board connector while the connector installed at a circuit board is called a board-to-wire connector. Although the functions of both connectors are simple, they are usually applied in the circuits of electronic products. Since the space relationship between a cable and a circuit board may be changed with the locations of the associated electronic devices, the structural strength of those connectors is important and necessary for ensuring a stable communication therebetween. On the other hand, due to the highly competition of electronic components, the cost is a key point for maintaining the competitiveness of connector components on the market.

With slim and light demand on electronic products, wire-to-board connectors for connecting with board-to-wire connectors installed at electronic products need continuous process.

In downsizing the wire-to-board connectors, they should also have an adequate strength to withstand multiple repeated connecting and disconnecting operations. The existing wire-to-board connectors employ elastic arms in recesses thereof to engage with the enlarged ends of corresponding supports of the board-to-wire connectors to increase the connection strength between them and the board-to-wire connectors.

However, the elastic arms of the existing wire-to-board connectors may lose their original elasticity after multiple repeated connections and disconnections. Thus, the connection strength between the existing wire-to-board connectors and the board-to-wire connectors may be reduced, and thus the existing wire-to-board connectors may be raised above the corresponding board-to-wire connectors, thereby reducing the reliability and stability of the connection therebetween. In another situation, when the elastic arms are broken, the remained elastic parts will not have a full capability of engaging the connectors, users often need to adjust the engagement angle between the connectors by nails or sharp tools, to ensure the stability of signal communication. Even worse, the broken parts left in connectors of electronic products will damage the connectors if they are not removed.

Furthermore, since the elastic arms used in the existing wire-to-board connectors should be formed as a z-shaped structure, so that the mold for manufacturing the elastic arms become complicated and the molded structure may occupy a larger space. Thus, for conforming the trend of product miniaturization, the existing wire-to-board connectors have some difficulty.

In view of the foregoing, the existing wire-to-board connectors has disadvantages, including inadequate structural strength which may cause troubles after multiple repeated connections and disconnections, difficulty in product miniaturization, and complexity of structure and associated mold. For solving the disadvantages, the applicant has contrived an improved wire-to-board connector, which can provide an adequate strength in structure to meet the habits of users in using wire-to-board connectors.

SUMMARY OF THE INVENTION

One aspect of the present invention is to provide a wire-to-board connector, which employs a solid protrusion in each engaging hole to increase the connection strength between the wire-to-board connector and a corresponding board-to-wire connector, and increase the entire structural strength of the wire-to-board connector.

Another aspect of the present invention is to provide a wire-to-board connector, which can simplify the structure thereof and increase the product yield.

A further aspect of the present invention is to provide a wire-to-board connector, which can simplify the structure thereof, achieve a miniaturization thereof, and avoid the disadvantages of the existing wire-to-board connectors, where the elastic arms thereof become weak due to a miniaturization and thus cannot withstand multiple repeated connecting and disconnecting operations, and thus the connection strength between the existing wire-to-board connectors and the board-to-wire connectors can be reduced, thereby causing the existing wire-to-board connectors to be raised and thus reducing the stability of transmitting signals.

To achieve the above aspects, the present invention provides a wire-to-board connector for connection to a board-to-wire connector that includes a plastic body having a raised portion and two coupling portions at two opposite sides of the raised portion, wherein the raised portion defines multiple through holes extending in a longitudinal direction thereof, each coupling portion is formed at its front with an upright support having an enlarged top end, and multiple conductive terminals are fitted through the multiple through holes, wherein each conductive terminal has a fixed section disposed in one through hole of the raised portion, a solder section extending backwardly from the fixed section to be soldered onto a circuit board, and a connecting section extending forwardly from the fixed section and protruding out of the through hole of the raised portion of the plastic body. The wire-to-board connector comprises a dielectric housing and multiple conductive terminals. The dielectric housing has a top surface and a bottom surface and defines two engaging holes, which pass through the top and bottom surfaces, at two opposite sides thereof corresponding to the upright supports of the plastic body of the board-to-wire connector and defines multiple positioning recesses corresponding to the connecting sections of the multiple conductive terminals of the board-to-wire connector. The multiple conductive terminals are disposed in the multiple positioning recesses for electrical connection with the connecting sections of the conductive terminals of the board-to-wire connector, wherein a protrusion is formed on an inner surface of each engaging hole, corresponding to the enlarged top end of each upright support of the board-to-wire connector.

The wire-to-board connector disclosed in the present invention employs a solid protrusion in each engaging hole, which has an improved effect over the elastic arms used in the existing wire-to-board connectors. Thus, the wire-to-board connector of the present invention has an increased structural strength to withstand multiple repeated connections and disconnections, so that the connection strength between the wire-to-board connector and the corresponding board-to-wire connector can be enhanced, the engagement structure can be simplified, the product yield can be increased, the cost of the associated mold can be reduced, and a miniaturization for the connectors can be achieved. With the present invention, the problems of elasticity loss or breakage of the elastic arms occurred in the existing wire-to-board connectors, which may cause the existing wire-to-board connectors to be raised and thus may affect the stability of transmitting signals, can be avoided. Besides, a miniaturization of the product can be achieved in addition to an increase of the product yield.

DETAILED DESCRIPTION OF THE ILLUSTRATED EMBODIMENTS

Figure 1:
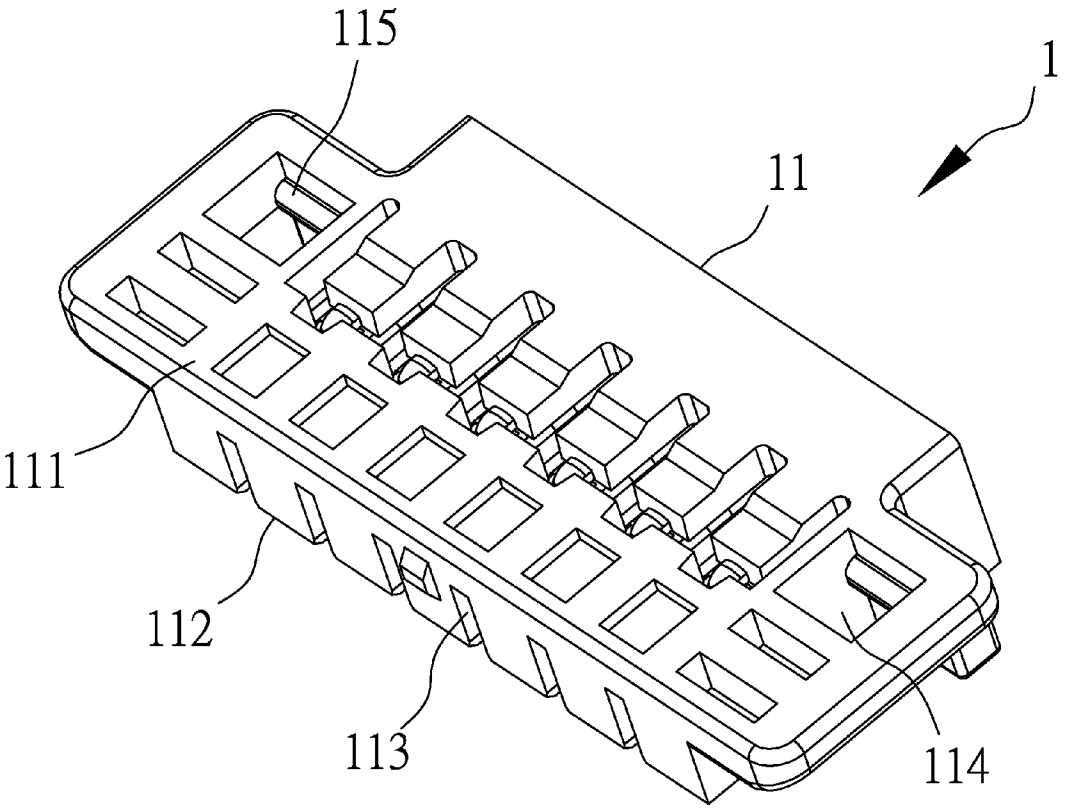
FIG. 1 shows a 3-dimensional view of an electrical connector according one embodiment of the present invention.
Figure 2:
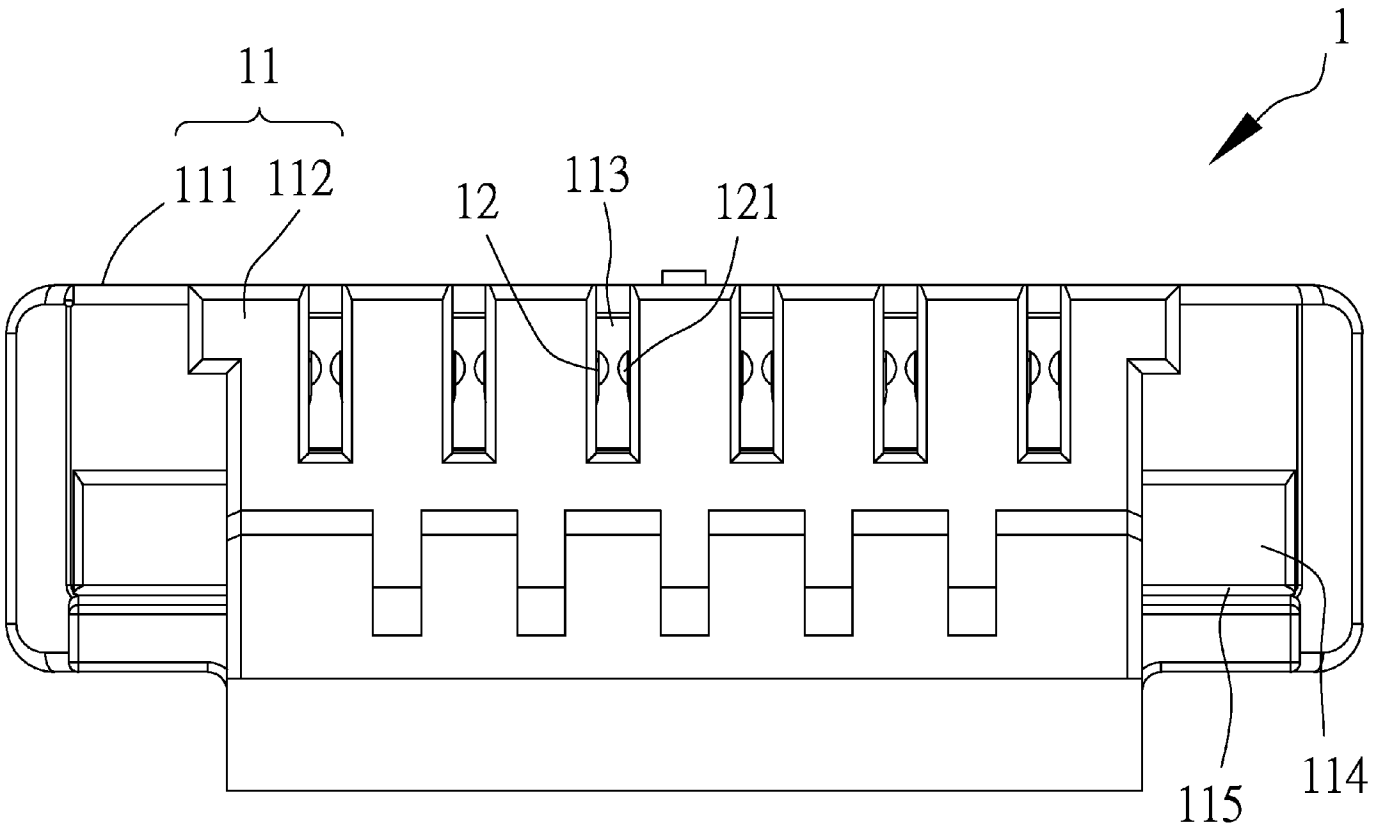
FIG. 2 shows a bottom view of the electrical connector of the embodiment of the present invention.
Figure 3:
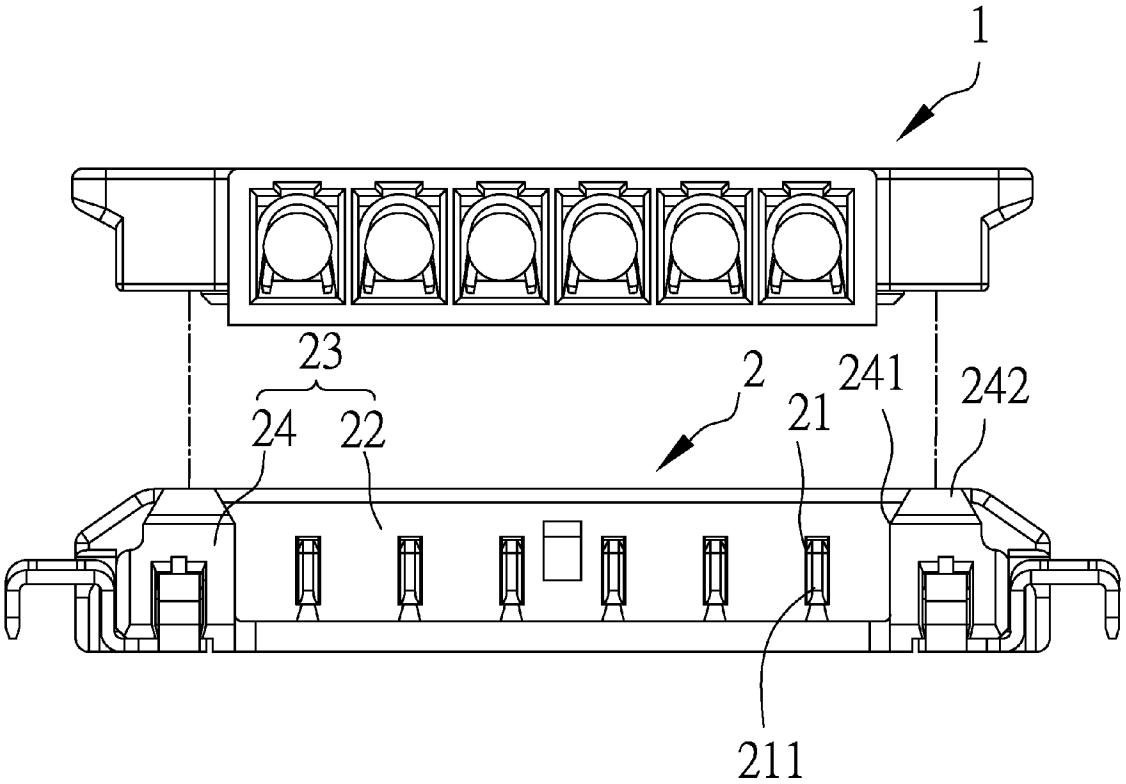
FIG. 3 shows a schematic view of the electrical connector of the embodiment for connecting with a corresponding board-to-wire connector, wherein the engaging holes of the electrical connector of the present invention are aligned with the upright supports of the corresponding board-to-wire connector for performing an engaging operation.
Figure 4:
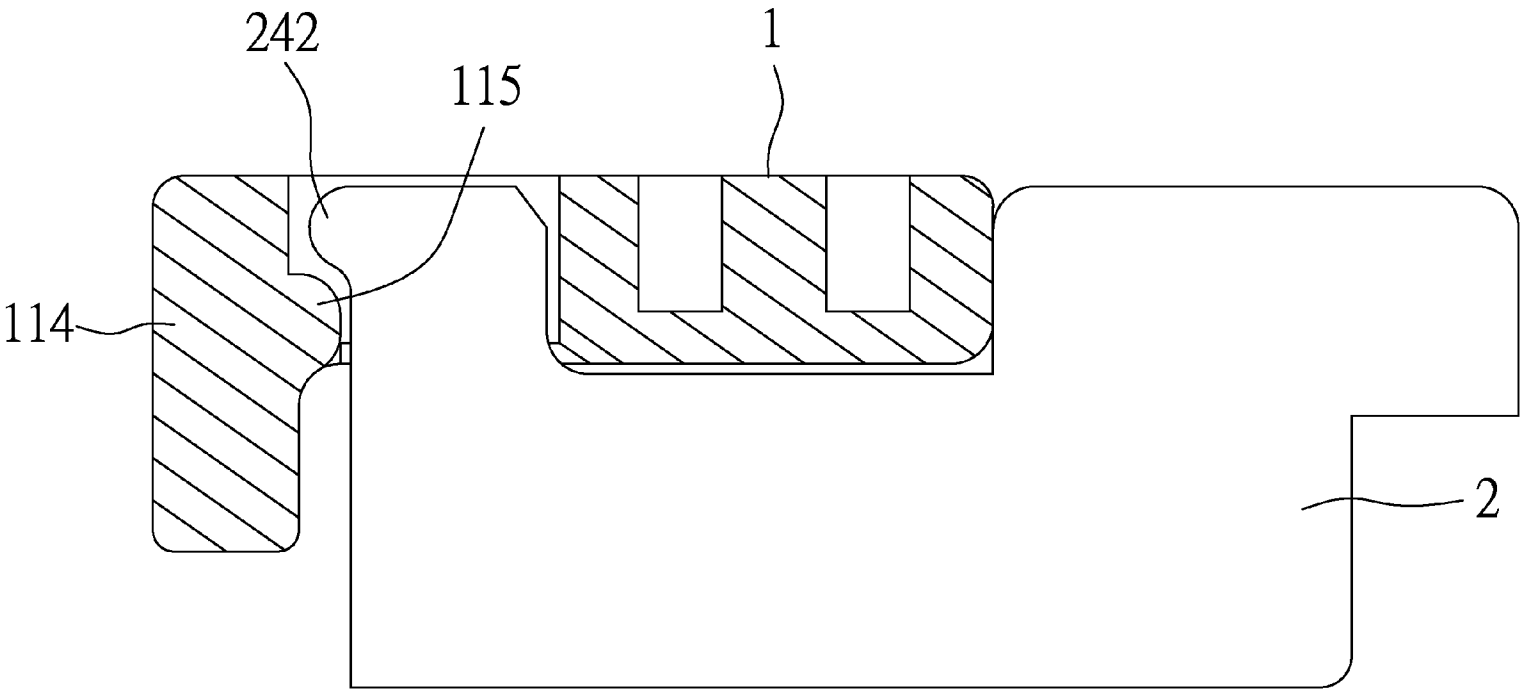
FIG. 4 shows a sectional view of the electrical connector of the embodiment in connection with the corresponding board-to-wire connector, wherein the protrusion in each engaging hole of the electrical connector corresponds to the enlarged top end of each upright support of the corresponding board-to-wire connector.

The following paragraphs will illustrate a preferred embodiment with reference to the accompanying drawings to demonstrate the technical contents, features, and merits of the present invention. In the preferred embodiment, same elements will be indicated by similar reference numerals.

Referring to FIGS. 1 through 4, a wire-to-board connector according to the preferred embodiment of the present invention is shown, which generally comprises a dielectric housing 11, which has a top surface 111 and a bottom surface 112, and multiple conductive terminals 12. The dielectric housing 11 is made of dielectric material, which is electrically insulated under general household voltage and current. In the embodiment, the dielectric material used to produce the dielectric housing 11 is plastic material.

The dielectric housing 11 defines multiple positioning recesses 113, each corresponding to one of the connecting sections 211 of the conductive terminals 21 of a corresponding board-to-wire connector 2. Each of the connecting sections 211 extends from a fixed section (not shown) of a conductive terminal 21 disposed within a channel (not shown) defined by the raised portion 22 of the connector 2 and protrudes out of the channel beyond the plastic body 23. The connecting sections 211 are each shaped into a flat plate, so that the conducting sections 211 can be prevented from being damaged when they are subject to a downward force in a connecting operation. Furthermore, the conductive terminals 12 are disposed within the positioning recesses 113 for establishing electrical connection between the wire-to-board connector 1 and the board-to-wire connector 2. Also, each conductive terminal 12 is provided with at least two opposite engaging portions 121, so that when the wire-to-board connector 1 is connected with the board-to-wire connector 2, the conductive terminals 12 made of metal material can be firmly connected to the connecting sections 211 of the conductive terminals 21, thereby enhancing the stability and reliability of signal communication.

The dielectric housing 11 is manufactured by injection molding and formed with two engaging holes 114 that pass through the top surface 111 and the bottom surface 112, wherein each engaging hole 114 is formed with a protrusion 115 corresponding to the enlarged top end 242 of the upright support 241 of the board-to-wire connector 2. When the wire-to-board connector 1 is connected to the board-to-wire connector 2, the upright supports 241 of the respective coupling portion 24 of the connector 2 are inserted through the engaging holes 114 of the dielectric housing 11 of the connector 1, and the protrusions 115 in the respective engaging holes 114 engage the enlarged top ends 242 of the respective upright supports 241, so that the connection strength between the wire-to-board connector 1 and the board-to-wire connector 2 can be enhanced.

Figure 5:
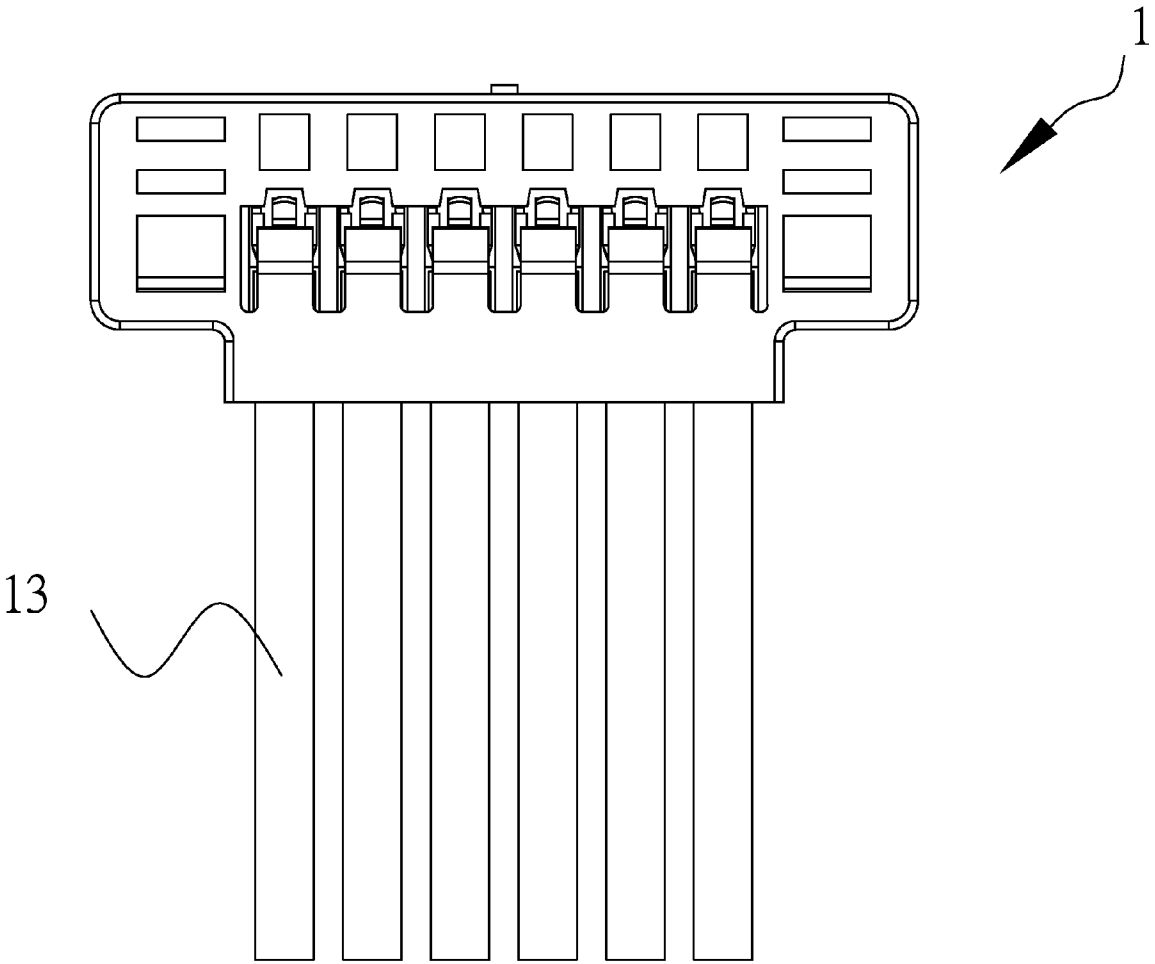
FIG. 5 shows a top view of the electrical connector of the embodiment, wherein multiple electrical lines are provided at a side of the electrical connector.

As shown in FIG. 5, a person skilled in the art can easily understand that the wire-to-board connector 1 can be further provided with multiple electrical lines 13 at a side of the dielectric housing 11 opposite to the multiple positioning recesses 113. In the preferred embodiment, the multiple electrical lines 13 can be implemented by a ribbon cable or other similar means for transmitting current or electronic signals.

In light of the foregoing, the wire-to-board connector disclosed herein employs protrusions formed in the engaging holes instead of elastic arms used in the existing wire-to-board connectors, leading to a simple structure and an increased product yield. Also, the electrical connector of the present invention can overcome the disadvantages of the existing wire-to-board connectors, where the elastic arms thereof may lose their original elasticity after repeated connecting and disconnecting operations to cause the connectors to be raised, thus reducing the connection strength and thus reducing the reliability and stability of the connection. Besides, the electrical connector of the present invention can increase product service life without worrying a breakage of the elastic arms used in the existing connectors.

While the invention has been described with reference to the preferred embodiment above, it should be recognized that the preferred embodiment is given for the purpose of illustration only and is not intended to limit the scope of the present invention and that various modifications and changes, which will be apparent to those skilled in the relevant art, may be made without departing from the spirit and scope of the invention.

What is claimed is:

1. A wire-to-board connector for connection to a board-to-wire connector that includes a plastic body having a raised portion and two coupling portions disposed at two opposite sides of the raised portion, wherein the raised portion defines multiple channels extending in a longitudinal direction thereof, each of the coupling portions is formed at its front with an upright support having an enlarged top end, and multiple conductive terminals are fitted through the multiple channels along the longitudinal direction, wherein each of the conductive terminals has a fixed section disposed within a corresponding one of the channels, a solder section extending backwardly from the fixed section to be soldered onto a circuit board, and a connecting section extending forwardly from the fixed section and protruding beyond the plastic body; the wire-to-board connector comprising:

a dielectric housing having a top surface and a bottom surface and formed with two engaging holes, which pass through the top and bottom surfaces and disposed at two opposite sides of the dielectric housing in a manner corresponding to the upright supports, and multiple positioning recesses corresponding to the connecting sections; and multiple conductive terminals disposed within the multiple positioning recesses for electrical connection to the connecting sections, wherein each of the engaging holes is formed with a protrusion corresponding to the enlarged top end.

2. The wire-to-board connector of claim 1, further comprising multiple electrical lines connected to the dielectric housing along the longitudinal direction and adapted for transmitting current or electronic signals.

3. The wire-to-board connector of claim 1, wherein each of the conductive terminals is provided with at least two engaging portions.

* * * * *